US006598631B2

(12) United States Patent
Hewlitt et al.

(10) Patent No.: US 6,598,631 B2
(45) Date of Patent: Jul. 29, 2003

(54) DEVICE AND PROCESS FOR PRODUCT RECONSTITUTION

(75) Inventors: Timothy Hewlitt, London (GB); Steven Kelsey, London (GB); William Maskell, London (GB); Jerard O'Brien, London (GB)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/843,428

(22) Filed: Apr. 25, 2001

(65) Prior Publication Data

US 2002/0066496 A1 Jun. 6, 2002

(30) Foreign Application Priority Data

Apr. 25, 2000 (EP) ..... 00303430

(51) Int. Cl.[7] ..... B65B 1/04; B65B 3/00; B67C 3/00

(52) U.S. Cl. ..... 141/383; 141/105; 141/255; 141/286

(58) Field of Search ..... 141/250, 255, 141/257, 285, 286, 383, 346–355, 105; 251/149.1; 137/614.03, 614.04; 220/86.2

(56) References Cited

U.S. PATENT DOCUMENTS

| | | | | |
|---|---|---|---|---|
| 3,167,210 A | | 1/1965 | Carney, Jr. | 220/63 |
| 3,802,470 A | | 4/1974 | Coleman | 141/5 |
| 3,938,564 A | * | 2/1976 | Jones | 141/352 |
| 3,966,091 A | | 6/1976 | Bencic | 222/129.1 |
| 4,006,841 A | | 2/1977 | Alticosalian | 222/42 |
| 4,077,182 A | | 3/1978 | Papaluca | 53/109 |
| 4,330,066 A | | 5/1982 | Berliner | 215/1 C |
| 4,340,153 A | | 7/1982 | Spivey | 222/1 |
| 4,598,840 A | | 7/1986 | Burg | 222/135 |
| 4,832,096 A | | 5/1989 | Kohlbach | 141/114 |
| 4,929,818 A | | 5/1990 | Bradbury et al. | 235/381 |
| 4,934,567 A | | 6/1990 | Vahjen et al. | 222/136 |
| 5,067,636 A | | 11/1991 | Pfeiffer et al. | 222/105 |
| 5,285,815 A | | 2/1994 | Henry et al. | 137/595 |
| 5,429,263 A | | 7/1995 | Haubenwallner | 220/404 |
| 5,474,111 A | | 12/1995 | Williamson et al. | 141/1 |
| 5,516,007 A | | 5/1996 | Larson | 222/105 |
| 5,568,828 A | * | 10/1996 | Harris | 141/348 |
| 5,685,435 A | | 11/1997 | Picioccio et al. | 209/677 |
| 5,730,330 A | | 3/1998 | Reading | 222/113 |
| 5,758,571 A | | 6/1998 | Kateman et al. | 99/455 |
| 5,948,461 A | | 9/1999 | Miller | 426/565 |
| 5,955,132 A | | 9/1999 | Spica et al. | 426/399 |
| 5,996,316 A | | 12/1999 | Kirschner | 53/443 |
| 5,996,824 A | | 12/1999 | Grant et al. | 215/2 |
| 5,997,236 A | | 12/1999 | Picioccio et al. | 414/403 |
| 6,058,984 A | | 5/2000 | Sato | 141/7 |
| 6,149,129 A | * | 11/2000 | Harris et al. | 251/149.1 |
| 6,250,348 B1 | * | 6/2001 | Reinholdt | 141/382 |

FOREIGN PATENT DOCUMENTS

| | | | |
|---|---|---|---|
| DE | 27 14 919 A1 | 10/1977 | B65D/43/02 |
| DE | 37 27 789 A1 | 3/1988 | B65D/47/20 |
| DE | 39 22 779 A1 | 1/1991 | B65B/3/04 |
| DE | 44 39 914 A1 | 5/1996 | B65D/23/08 |
| DE | 196 07 255 A1 | 8/1997 | B65B/3/00 |

(List continued on next page.)

*Primary Examiner*—Timothy L. Maust

(57) ABSTRACT

A device is provided for the mixing of one or more concentrates and/or diluents at an interface between a container and a filling head as the container is filled using said filling head. In one embodiment, the process includes engaging said filling head and a fill aperture of said container so as to provide a direct path from said filling machine to the interior of the container; passing one or more concentrates and/or diluents to said filling head component, so as to mix said concentrate(s) and/or diluent(s); and passing the product thereby mixed at said interface to the interior of the container; and devices for use therein.

4 Claims, 5 Drawing Sheets

FOREIGN PATENT DOCUMENTS

| | | | | |
|---|---|---|---|---|
| DE | 198 13 842 A1 | 9/1999 | ..... | B65G/47/49 |
| DE | 299 13 528 U1 | 1/2000 | ..... | G07F/17/18 |
| DE | 199 36 645 A1 | 4/2000 | ..... | B67D/5/34 |
| EP | 0 358 053 A2 | 3/1990 | ..... | B65D/77/06 |
| EP | 0 479 113 A1 | 4/1992 | ..... | B67D/1/00 |
| EP | 0 499 918 A2 | 8/1992 | ..... | E21D/11/00 |
| EP | 0501015 A1 | 9/1992 | ..... | B65D/77/06 |
| EP | 0 528 394 A1 | 2/1993 | ..... | B65D/77/06 |
| EP | 0 649 121 A2 | 4/1995 | ..... | G07F/17/16 |
| FR | 1 180 592 | 6/1959 | ..... | 20/4 |
| GB | 2188906 A | 10/1987 | ..... | B67D/5/56 |
| GB | 2244977 A | 12/1991 | ..... | B67D/5/56 |
| WO | WO 94/24010 | 10/1994 | ..... | B65D/25/00 |
| WO | WO 96/01227 | 1/1996 | ..... | B67D/5/56 |
| WO | WO 97/02898 | 1/1997 | ..... | B05B/7/28 |
| WO | WO 97/18538 | 5/1997 | ..... | G07F/13/08 |
| WO | WO 00/03944 | 1/2000 | ..... | B67D/1/08 |

* cited by examiner

DEVICE AND PROCESS FOR PRODUCT RECONSTITUTION

This application claims priority to the foreign application filed on Apr. 25, 2000, in Europe and having a serial number of 00303430.3.

FIELD OF THE INVENTION

The present invention relates to a device and process for product reconstitution.

BACKGROUND OF THE INVENTION

Methods of product reconstitution are known in the art wherein liquid concentrates are mixed with a diluent by means of an aspirator containing a venturi. In this method, the venturi draws liquid concentrate into contact with the diluent stream, thereby mixing concentrate and diluent together. In such a method, any number of concentrates may be envisaged.

Other methods exist in the art, wherein concentrates are dosed into a container and a diluent added.

Yet another existing method entails the dissolution of a concentrate by active mixing of a concentrate dosed into a diluent and agitation by using a mechanical device such as a paddle or a rotating rod.

Filling machines may dispense a wide variety of products from the same machine. Such machines may include production line filling machines and vending systems that are designed to fill containers at sites located in, for example, retail outlets, offices and other workplaces.

By "vending system" in the present invention, is meant a filling machine that dispenses product in response to one or more selections that are input into the machine by the user. Such a system may be operated by coin, token, card, or other suitable means.

In another method of product reconstitution, typically used in filling machines, a concentrate diluent are dosed into a storage container located in said machine through a common nozzle or aperture prior to dispensing into a storage container located in said machine. In such a method there is the potential for contamination of the product with residual product from the previous vend.

In a situation where multiple vends of a variety of concentrate combinations are required from the same machine, the potential for contamination is increased.

Typically, the design of filling machines, such as vending machines, avoids the contamination issue by isolating the concentrates and filling them directly into the container prior to adding the diluent. This method is effective in avoiding contamination but does not allow the effective mixing and reconstitution of the concentrate.

The mixing of concentrates with diluents and/or the addition of customised combinations of concentrates adds complexity and the potential for contamination in filling machines.

The alternative method of dispensing concentrates into the container and adding the diluent does not provide a consistently well mixed product and limits the range of concentrate formulations possible by such a method to those formulations that have an inherently high solubility.

Methods that attempt to improve reconstitution through the introduction of turbulence or shear in the concentrate and/or the diluent can induce foaming in the product that reduces product fill rates.

Solutions to the problems noted above result in filling nozzles of greater complexity and greater cost than the dispense mechanisms typically used in filling machines such as vending systems, thereby rendering solutions to the problems impractical on cost grounds.

SUMMARY OF THE INVENTION

According to the present invention there is provided a device for the mixing of one or more concentrates and/or diluents at an interface between a container and a filling head. In one embodiment, a combination is provided, comprising:

(i) a filling head component, comprising one or more concentrate and/or diluent inlet tubes, said inlet tubes being in fluid communication with a central chamber, said chamber comprising therein a diverter, said diverter being such that the difference between the diameter of the diverter and that of the surrounding chamber is such that the cross-sectional area of the nozzle section gradually increases in the direction of flow of the filling head component; and (ii) a component located in a fill aperture of a container, said components being engageable with one another so as to provide a direct path from said filling head to the interior of the container.

There is further provided a device for the mixing of one or more concentrates and/or diluents at an interface between a container and a filling head as the container is filled using said filling head, comprising the combination of:

(i) a filling head component comprising one or more concentrate and/or diluent inlet tubes, said inlet tubes being in fluid communication with a fill aperture of a container; and (ii) a diverter located in the fill aperture of said container, said diverter being such that the difference between the diameter of the diverter and that of the surrounding aperture is such that the cross-sectional area of the aperture section gradually increases in the direction of flow of the filling head component, said filling head component and said fill aperture being engageable with one another so as to provide a direct path from said filling head to the interior of the container.

In a further aspect, a process is provided for the mixing of one or more concentrates and/or diluents at an interface between a container and a filling head as the container is filled using said filling head, wherein said process comprises:

(i) engaging said filling head and a fill aperture of said container so as to provide a direct path from said filling machine to the interior of the container;

(ii) passing one or more concentrates and/or diluents to said filling head component, so as to mix said concentrate(s) and/or diluent(s) at the interface between the container and the filling head; and (iii) passing the product thereby mixed at said interface to the interior of the container.

In a further aspect of the present invention, there is provided a container comprising a component located in the fill aperture of the container, said component being engageable with a filling head component of a filling machine, said filling head component comprising one or more concentrate and/or diluent inlet tubes, said inlet tubes being in fluid communication with a central chamber, said chamber comprising therein a diverter, said diverter being such that the difference between the diameter of the diverter and that of the surrounding chamber is such that the cross-sectional area of the nozzle section gradually increases in the direction of flow of the filling head component, so as to provide a direct path from the filling head of the filling machine to the interior of the container, thereby allowing mixing of one or more concentrates and/or diluents at an interface between the container and said filling head as said container is filled.

As will be described below, product passes through the chamber between said component and the fill aperture.

By "interface between a container and a filling head", is meant a chamber formed by the filling head and the optional diverter therein and/or the chamber formed by the fill aperture and the component or diverter therein.

The component located in the fill aperture of said container according to the present invention, may be designed so that the chamber between the fill aperture and said component remains closed until connected to the filling head component. However, it will be appreciated that in the case where the fill aperture also acts as the dispense aperture, said component may be designed so that the chamber may be opened manually by the user, in addition to automatic opening when in connection with the filling head.

The nature of the component is not limited in the present invention, provided that the chamber between the fill aperture and said component may open and re-close by some function of the filling process, by the action of the filling machine, or a mechanism thereof, or by the inherent nature of the fill aperture, and that said component fits together with the filling head nozzle so as to provide a direct path from the filling head to the interior of the container. The surface of said component may be straight, tapered or flared with respect to the direction of product flow, that is to say, the difference between the diameter of the complementary component and that of the fill aperture may gradually increase, decrease or keep constant, the cross-sectional area of the aperture section in the direction of flow of the filling head component.

In a further aspect of the present invention, there is provided a filling machine comprising a filling head, wherein said filling head comprises:

a filling head component, comprising one or more concentrate and/or diluent inlet tubes, said inlet tubes being in fluid communication with a central chamber.

In a preferred embodiment of the present invention, there is provided a filling machine comprising a filling head, wherein said filling head comprises:

a filling head component, comprising one or more concentrate and/or diluent inlet tubes, said inlet tubes being in fluid communication with a central chamber, said chamber comprising therein a diverter, said diverter being such that the difference between the diameter of the diverter and that of the surrounding chamber is such that the cross-sectional area of the nozzle section gradually increases in the direction of flow of the filling head.

The design of the filling head of the filling machine according to the present invention, which may provide a single filling point, simplifies the filling machine design and therefore reduces filling machine cost.

The design also serves to eliminate contamination problems arising from previous product mixtures, by providing discrete concentrate and diluent inlet tubes, and by ensuring mixing of concentrates and/or diluents does not occur in the filling machine, but at the interface between a container and a filling head upon dispense.

The design of the diverter and surrounding chamber facilitates high speed filling into the container and further serves to allow low turbulence mixing upon filling, thereby preventing foaming.

By placing a component in the container, which is engageable with the filling head component, it is possible to reduce the functionality required in the filling machine, that is to say said component may be moulded and introduced into said container at low cost, compared with the introduction of a similar component into the filling head of the filling machine.

In a preferred embodiment of the present invention, the diverter is torpedo-shaped. In a further preferred embodiment, the diverter may be of a square or rectangular cross-section, as seen in the horizontal plane and a taper that can exhibit a hyperbolic or exponential curve or cross-section, depending on the reconstitution requirements of the product.

The position of the diverter relative to the surrounding chamber may be varied about any axis, in order to regulate the flow of concentrate or diluent (in terms of product volume over time, or velocity across the associated surfaces) in order to effect reliable reconstitution, to effect speed of fill, or to effect reduction in foaming.

The diverter may be a free-floating element trapped within the mixing chamber. On the action of filling, the diverter may be positioned centrally within said chamber by the action of the flow of concentrate and diluent.

An interrupted ring may be added to a point from the base of the mixing diverter, which may conveniently be one-third from the base of said diverter, in order to produce a stand-off device to prevent the initial flow of product pressing the diverter against the exit to the mixing chamber, and thereby accidentally effecting a seal.

As an alternative to this detail, grooves may be included in the interior of the base of the mixing chamber to allow the initial flow of product to pass beneath the diverter, and to initiate the positioning of the diverter at the centre of the mixing chamber.

In a further embodiment of the present invention, there is provided a process for the mixing of one or more concentrates and/or diluents at an interface between a container and a filling head as the container is filled using said filling head, wherein said process employs a device according to the present invention.

In a further aspect, the present invention provides a container comprising a fill aperture, said fill aperture comprising therein a diverter, said diverter being such that the difference between the diameter of the diverter and that of the surrounding aperture is such that the cross-sectional area of the aperture section gradually increases in the direction of flow of the filling head component, so as to pass the product thereby reconstituted to the interior of the container.

Thus, in this embodiment, the diverter may be contained entirely within the container as an injection moulded or fabricated component, and the fill apertures communicating with the filling head may be one or more simple apertures. It will be appreciated that in this embodiment the diverter shape may be modified to comprise a torpedo-shaped upper section and a lower section whose shape is not limited. Said lower section may conveniently comprise a straight, tapered or flared profile, that is to say, the difference between the diameter of the lower section and that of the fill aperture may gradually increase, decrease or keep constant, the cross-sectional area of the aperture section in the direction of flow of the filling head component.

As the engineering detail and complexity in this embodiment are located in the mass-produced container, and not in the filling machine, it is possible to reduce implementation cost.

The position of said diverter and associated fill and dispense apertures is not limited. Thus, it will be appreciated by one skilled in the art that said features may be present in the side walls of the container, as an alternative to being located in the upper portion of said container.

It will be appreciated by one skilled in the art that the fill aperture will preferably open and re-close by some function of the filling process, by the action of the filling machine, or a mechanism thereof. It will be further appreciated that in the case where the fill aperture also acts as the dispense aperture, that said fill aperture may be designed to be opened manually by the user, in addition to automatic opening when in connection with the filling head.

In a preferred embodiment of the present invention, the filling machine is a vending system.

The nature of the containers according to the present invention are not limited. However, for both economic and environmental reasons, it is highly desirable to employ reusable containers, that is to say where the container is returned to the point of sale or dispense to be refilled once emptied of its contents. This process may be repeated many times, and the container may be refilled with contents different to those previously in the container.

Such containers are available in a wide variety of shapes and forms. They may be assembled from a wide variety of components, and may be manufactured from a wide variety of materials.

In one embodiment of the present invention, said containers may be manufactured from a plastics material. As such, said container may be manufactured by any conventional process for the forming of plastics material. Suitable plastics materials include any appropriate to the requirements of the product including, by way of example, Polyethylene Terephthalate (PET), Polypropylene (PP), Polyethylene (PE), High Density Polyethylene (HDPE), Polyvinyl Chloride (PVC) and barrier laminates such as PET/NYLON/PET and PP/BAREX®/PP etc. (BAREX® is a trade mark of BP Amoco plc).

In a preferred embodiment of the present invention, said containers may be manufactured by an extrusion or injection blow-moulding process.

Containers according to the present invention generally have a bottom wall, peripheral side walls, and an upper portion comprising one or more fill and/or dispense apertures. The terms "bottom", "side" and "upper" are used to identify those positions of the container when it is in its normal orientation in use.

In a preferred embodiment of the present invention, said peripheral side walls may be of a collapsible nature. It will be appreciated by one skilled in the art, that for convenience, said bottom wall and/or upper portion may be also be of a collapsible nature.

The upper portion may be an integral part of the container, or it may be securely sealed to the peripheral side walls by any technique commonly used in the art. Suitable techniques include heat sealing, ultrasonic sealing and the use of adhesives.

In a preferred embodiment of the present invention, containers according to the present invention may comprise a collapsible bag or sachet.

The container may comprise any number, combination and orientation of fill and/or dispense apertures that meet the needs of the product, its intended use or its method of use.

Containers according to the present invention may include any dispensing, dosing or application feature or device providing the means to dispense the product in a wide variety of ways.

The containers may include provision for manual or powered dispensing.

The container may include any further device or mechanism for filling known in the art.

Containers according to the present invention may comprise an exhaust arrangement or in a preferred embodiment of the present invention, the container may be evacuated prior to being filled.

The nature of the dispense aperture closure is not limited and may be of any kind commonly used in the art.

The location of the fill aperture is not limited in the present invention. However, in a preferred embodiment of the present invention, the fill aperture will be centrally located on the container.

By "centrally located" in the present specification is meant that the location of the fill aperture or apertures provides a symmetry, thereby allowing the container to be filled independently of the orientation of the container when placed in the filling machine.

By "filling head" in the present invention, is meant the nozzle of the filling machine that dispenses the product. It will be appreciated that the filling machine may comprise multiple filling heads. A filling machine may be a vending machine that can dispense product in response to one or more selections that are input into the machine by the user. Such a machine may be operated by coin, token, card, or other suitable means.

In a preferred embodiment of the present invention, the fill aperture of the container may be in fluid communication with one or more tubes which extend to the bottom of said container, thereby allowing bottom filling. Suitable tubes may be of any kind commonly used in the art, and in a preferred embodiment will be flattened membrane tubes.

By "bottom filling" in the present invention, is meant that the tip of the filling head contacts, or is very closely adjacent to, the bottom of the container, that is to say incoming product is not discharged into the headspace but into the body of product present inside said container. Bottom filling helps eliminate air for products susceptible to foaming, for example, detergents.

By "headspace" in the present invention, is meant the space between the upper level (head) of the product stored in the container, and the limit of the cavity of said container.

In the case of said container being a bag or sachet, said tubes may be formed from the fabric of said bag or sachet.

Said tubes may be arranged in a variety of configurations and with a variety of apertures to allow filling of materials with varying viscosities and other characteristics such as particulates.

Containers according to the present invention, may be conveniently used to store and transport a wide variety of materials such as foodstuffs, beverages, household products such as detergents, and automotive products such as lubricants.

BRIEF DESCRIPTION OF THE DRAWINGS

The present invention will be described by way of example, with reference to the accompanying drawings. It is to be noted, however, that the accompanying drawings illustrate only some embodiments of the invention and are therefore not to be considered limiting of its scope, because the invention may admit to other equally effective embodiments.

DETAILED DESCRIPTION OF THE INVENTION

Figure 1:
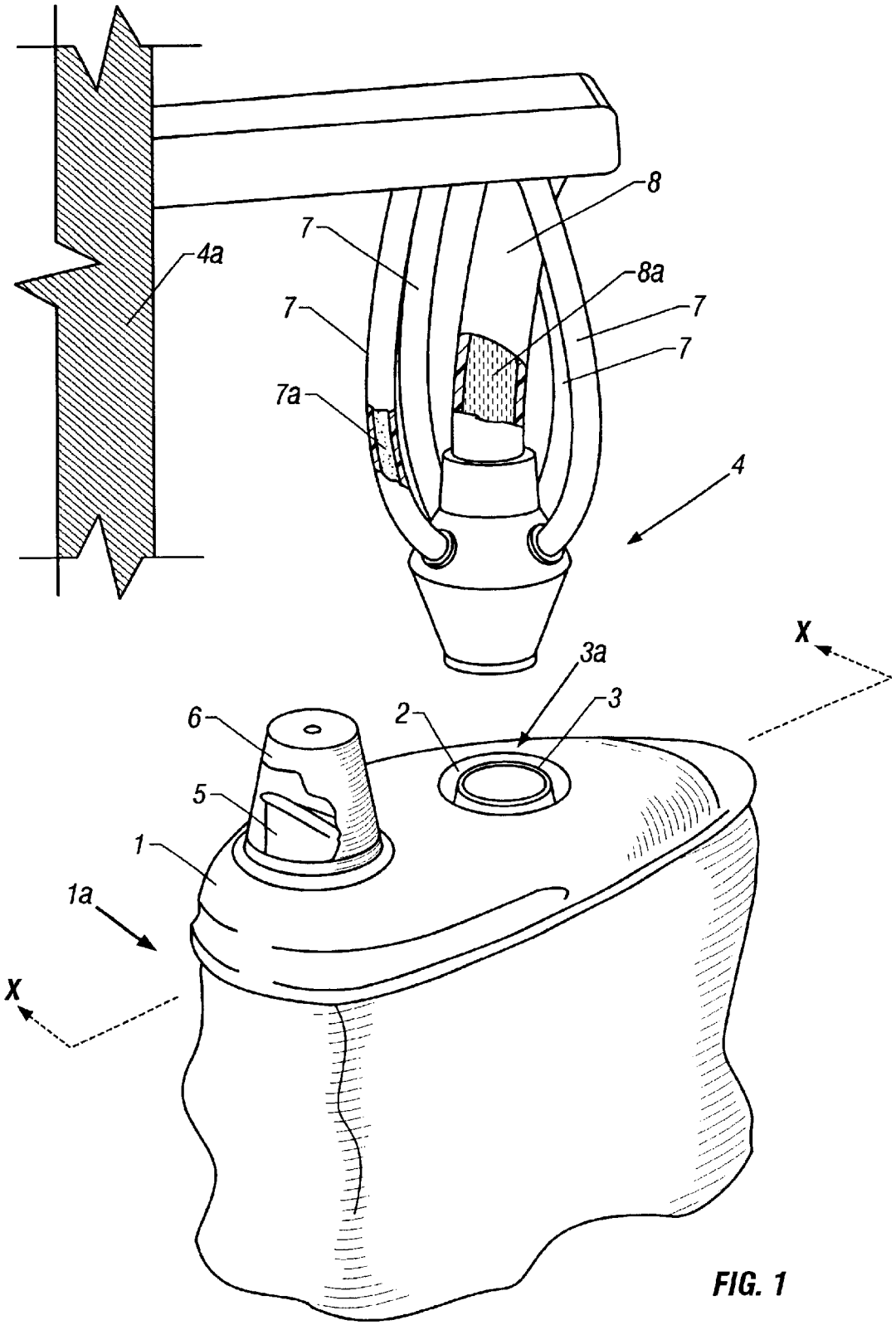
FIG. 1 is a fragmentary perspective view of a filling head component of a filling machine and an upper portion of a container comprising a component, shown prior to engagement of said components for allowing said container to be filled.

FIGS. 1–9 have similar elements that are similarly numbered and will be described in conjunction with each other and supplemented by reference to specific elements in particular figures.

An upper portion 1 of a container 1*a* comprises a fill aperture 2, said fill aperture 2 comprising a component 3, which is capable of forming an interface 3*a* with a filling head component of a filling machine 4*a*. Said upper portion 1 further comprises a dispense aperture 5 covered by a lid 6. Fill aperture 2 is centrally located within said upper portion 1. Said filling head component 4 can disperse various products and can comprise one or more inlet tubes 7, which may be used to disperse a concentrate material 7*a,* and one or more inlet tubes 8, which may be used to dispense a diluent material 8*a*.

Figure 2:
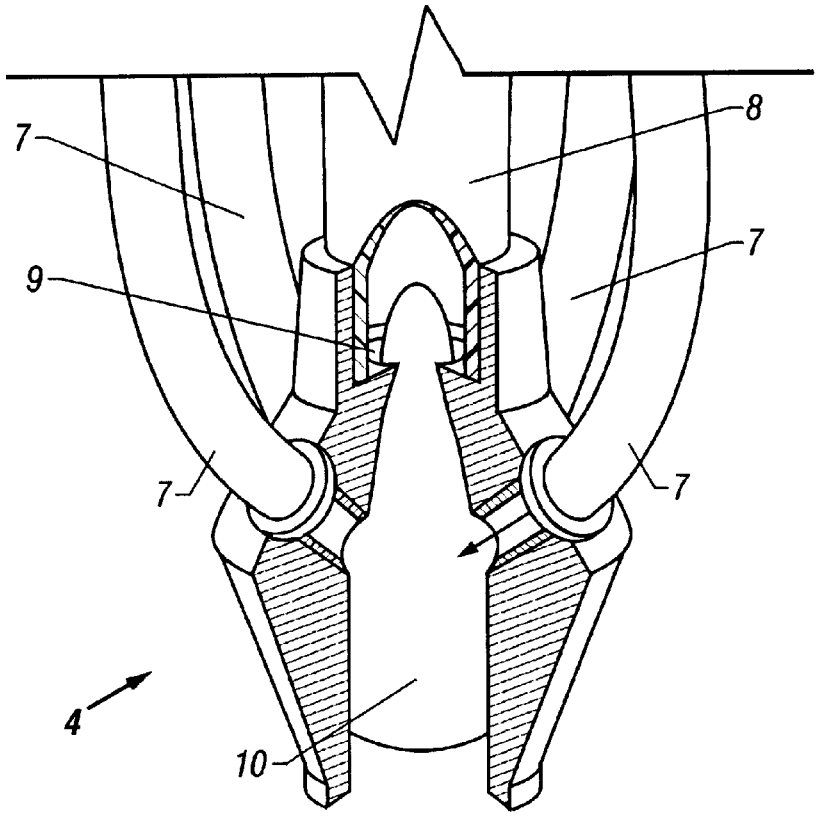
FIG. 2 is a fragmentary cutaway perspective view of said filling head component of a filling machine.

As shown in detail in FIG. 2 said inlet tubes 7 and 8 are in fluid communication with a central chamber 9. Said chamber 9 contains therein a torpedo-shaped diverter 10, said diverter 10 being such that the difference between the diameter of the diverter and that of the surrounding chamber gradually increases the dimension of the nozzle section that contacts incoming product.

Figure 3:
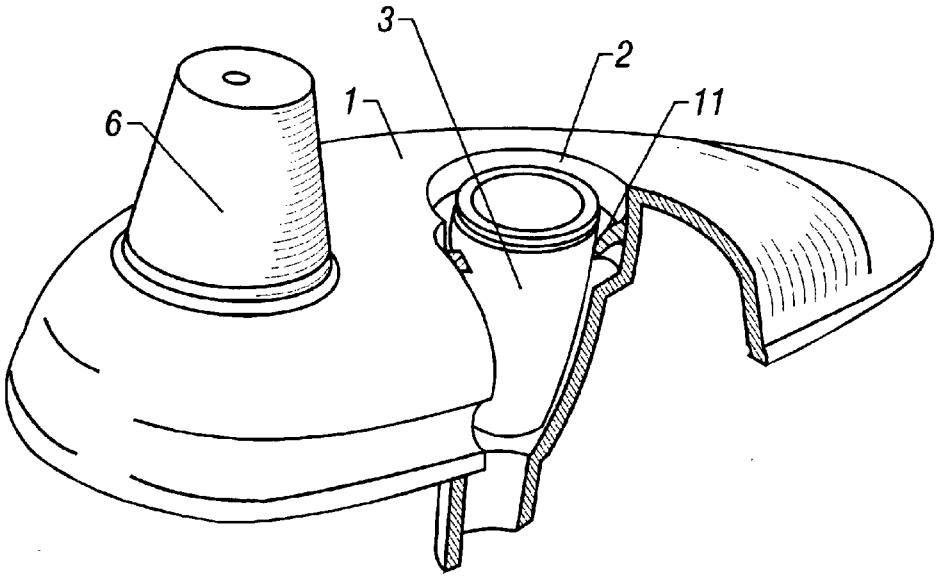
FIG. 3 is a fragmentary cutaway perspective view of said component of a container.
Figure 4:
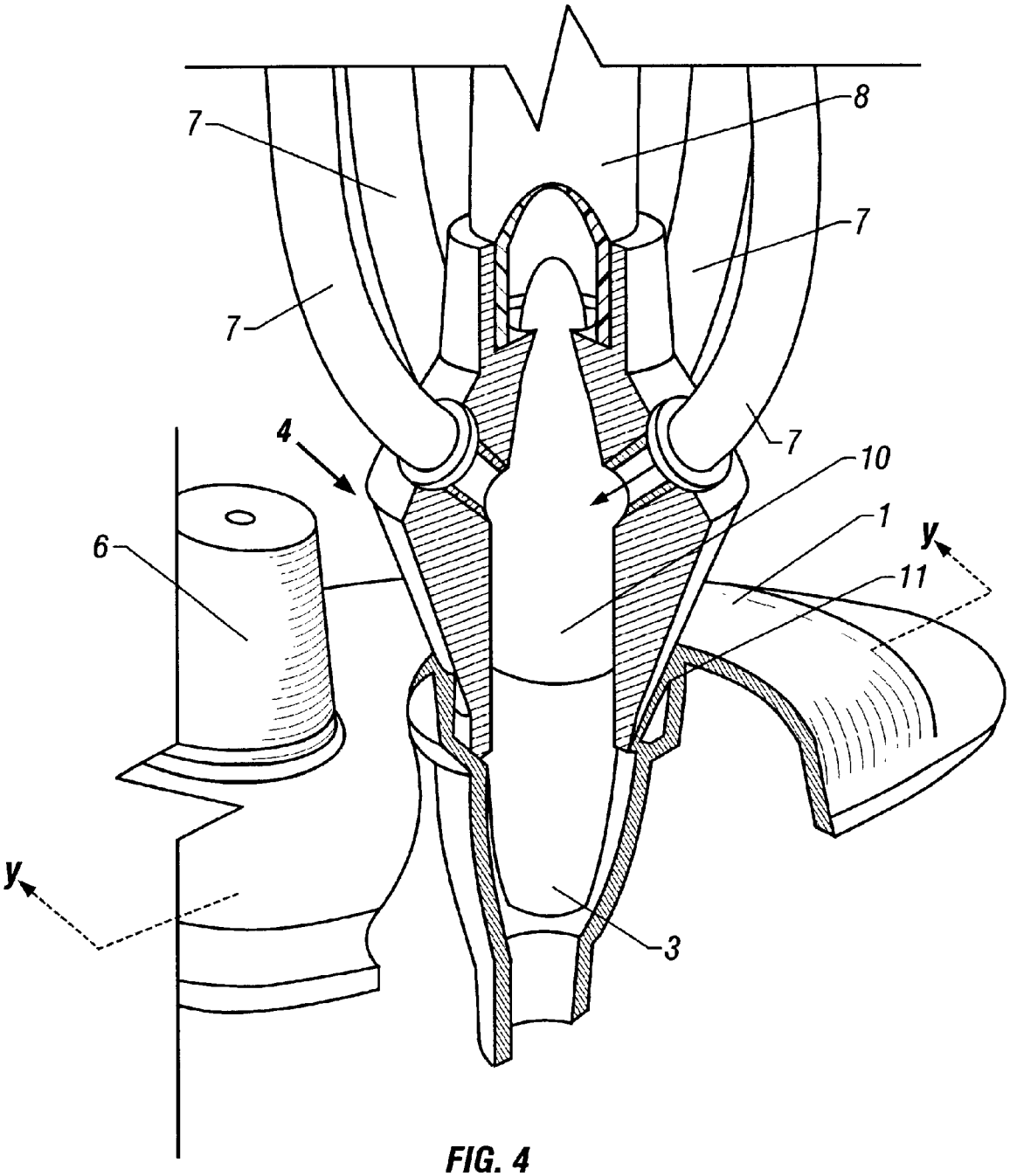
FIG. 4 is a fragmentary cutaway perspective view of an interface between said filling head component of a filling machine and said component of the container, showing said components in engagement for allowing said container to be filled;.

As shown in detail in FIG. 3, said component 3 is located in said upper portion 1 of the container (not shown) and is surrounded by a rubber sealing flange 11.

The action of inserting said filling head component 4 into said fill aperture 2 of said container displaces said rubber sealing flange 11, so as to provide a direct route from said filling machine to the interior of said container.

Figure 5:
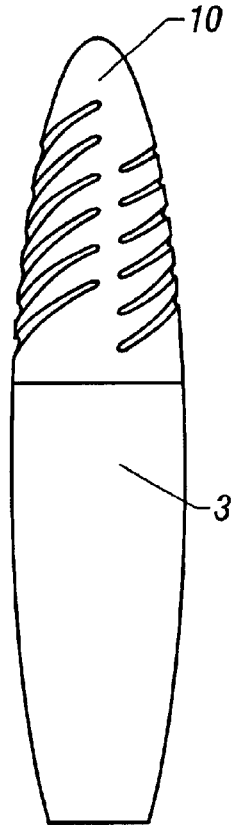
FIG. 5 is an elevational view of a diverter and said component of the container.
Figure 6:
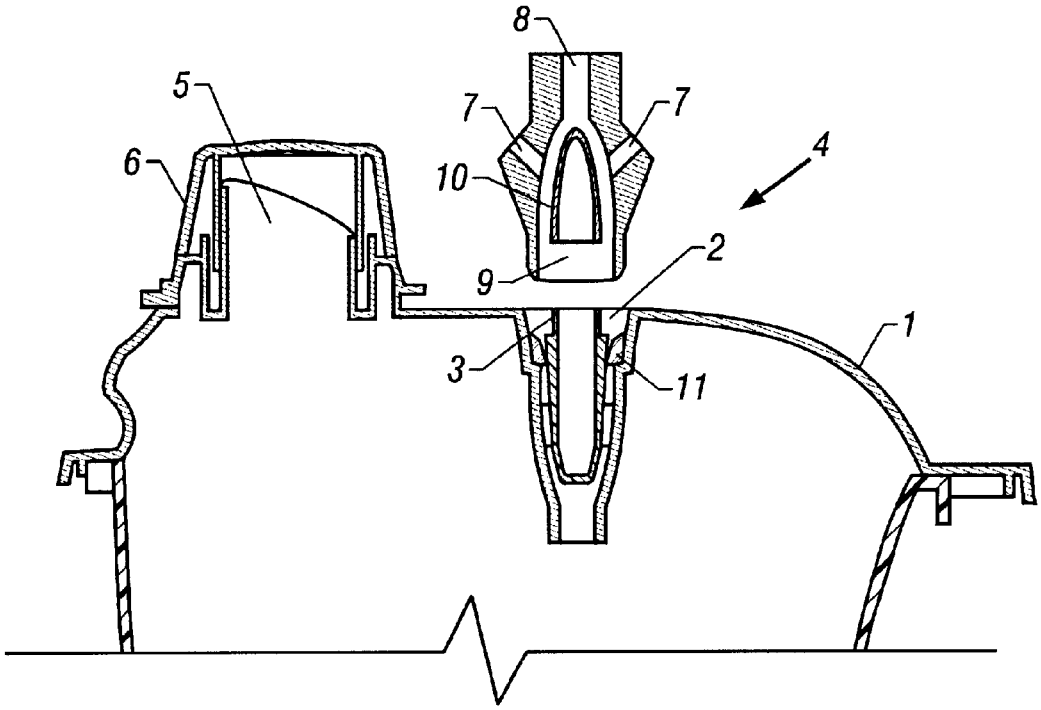
FIG. 6 is a cross-sectional elevation through said filling head component of a filling machine and said upper portion of a container comprising a complementary component, taken along the line X—X in FIG. 1.

FIG. 5 shows an elevational view of the interface between said torpedo-shaped diverter 10 and said component 3 of the container, said component 3 being tapered in the direction of product flow. The interface between said torpedo-shaped diverter 10 and said component 3 provides a surface over which product may flow. The diverter 10 comprises flutes that serve to produce a vortex and turbulence in order to aid mixing.

Whilst said component 3 is located in said upper portion 1 of a container, said diverter 10 may either be located in said filling head component 4 or be located in the upper portion 1 of the container. In the latter arrangement, the diverter 10 and component 3 therefore form upper and lower sections of a diverter located in said upper portion 1 of the container.

Figure 7:
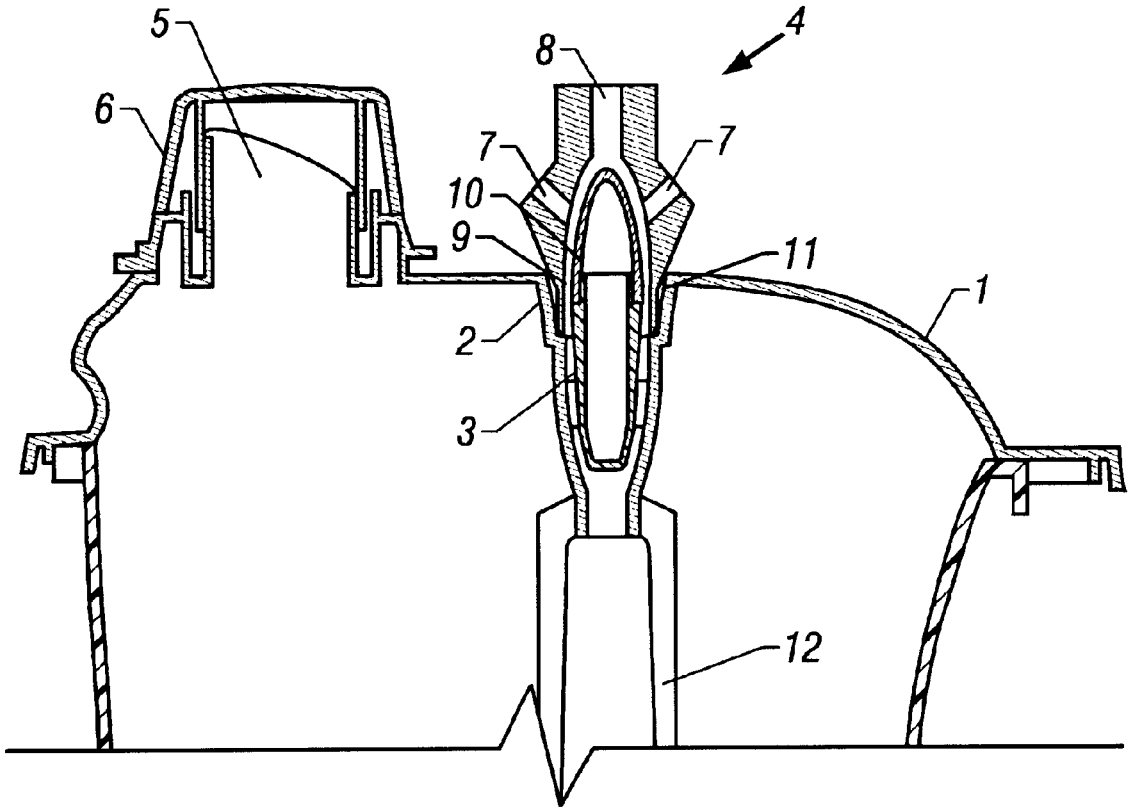
FIG. 7 is a cross-sectional elevation through said interface between said filling head component of the filling machine and said component of the container, taken along the line Y—Y in FIG. 4.

The container may be provided with an optional membrane tube 12 which facilitates bottom filling of said container, shown in FIG. 7.

While the foregoing is directed to various embodiments of the present invention, other and further embodiments may be devised without departing from the basic scope thereof. For example, the various methods and embodiments of the invention can be included in combination with each other to produce variations of the disclosed methods and embodiments. Also, the directions such as "top," "bottom," "left," "right," "upper," "lower," and other directions and orientations are described herein for clarity in reference to the figures and are not to be limiting of the actual device or system or use of the device or system. The device or system may be used in a number of directions and orientations. Further, the order of steps can occur in a variety of sequences unless otherwise specifically limited. The various steps described herein can be combined with other steps, interlineated with the stated steps, and/or split into multiple steps.

What is claimed is:

1. A device for mixing of one or more concentrates and/or diluents at an interface between a container and a filling head of a vending machine as the container is filled using said filling head, comprising the combination of:

(i) a filling head component, comprising one or more concentrate and/or diluent inlet tubes, said inlet tubes being in fluid communication with a central chamber, said chamber comprising therein a diverter, said diverter being such that the difference between the diameter of the diverter and that of the surrounding chamber is such that the cross-sectional area therebetween gradually increases in the direction of flow of the filling head component; and (ii) a component located in a fill aperture of a container, said components being engageable with one another so as to provide a direct path from said filling head to the interior of the container.

2. A device for the mixing of one or more concentrates and/or diluents at an interface between a container and a filling head of a vending machine as the container is filled using said filling head, comprising the combination of:

(i) a filling head component comprising one or more concentrate and/or diluent inlet tubes, said inlet tubes adapted to be in fluid communication with a fill aperture of a container; and (ii) a diverter located in the fill aperture of said container, said diverter being such that the difference between the diameter of the diverter and that of the surrounding aperture is such that the cross-sectional area of the aperture section gradually increases in the direction of flow of the filling head component, said filling head component and said fill aperture being engageable with one another so as to provide a direct path from said filling head to the interior of the container.

3. A container comprising a component located in the fill aperture of the container, said component being engageable with a filling head component of a filling head of a vending machine, said filling head component comprising one or more concentrate and/or diluent inlet tubes, said inlet tubes being in fluid communication with a central chamber, said chamber comprising therein a diverter, said diverter being such that the difference between the diameter of the diverter and that of the surrounding chamber is such that the cross-sectional area therebetween gradually increases in the direction of flow of the filling head component, so as to provide a direct path from the filling head of the vending machine to the interior of the container, thereby allowing mixing of one or more concentrates and/or diluents at an interface between the container and said filling head as said container is filled.

4. A container comprising a fill aperture, said fill aperture comprising therein a diverter, said diverter being such that the difference between the diameter of the diverter and that of the surrounding aperture is such that the cross-sectional area of the aperture section gradually increases in the direction of flow of a filling head component of a vending machine, so as to pass the product thereby reconstituted to the interior of the container.

* * * * *